US006688432B2

(12) United States Patent
Nissen et al.

(10) Patent No.: US 6,688,432 B2
(45) Date of Patent: Feb. 10, 2004

(54) PISTON COMPRESSOR

(75) Inventors: Jens Erik Nissen, Graasten (DK); Christian Svendsen, Padborg (DK); Frank Holm Iversen, Padborg (DK); Klaus Reinwand, Harrislee (DK); Preben Bjerre, Sønderborg (DK)

(73) Assignee: Danfoss Compressors GmbH, Flensburg (DE)

( * ) Notice: Subject to any disclaimer, the term of this patent is extended or adjusted under 35 U.S.C. 154(b) by 12 days.

(21) Appl. No.: 10/058,691

(22) Filed: Jan. 28, 2002

(65) Prior Publication Data

US 2002/0108813 A1 Aug. 15, 2002

(30) Foreign Application Priority Data

Feb. 10, 2001 (DE) ..... 101 06 234

(51) Int. Cl.[7] ..... F01M 1/06
(52) U.S. Cl. ..... 184/6.16; 184/11.1; 184/6.18
(58) Field of Search ..... 184/6.16, 6.17, 184/6.18, 11.1, 13.1, 24; 417/415

(56) References Cited

U.S. PATENT DOCUMENTS 2,504,528 A * 4/1950 Hume ..... 184/13.1
2,735,613 A * 2/1956 Calling ..... 184/11.1
3,451,615 A 7/1967 Hover ..... 230/206
4,569,639 A 2/1986 Hannibal et al. ..... 417/368
5,322,419 A * 6/1994 Novolan et al. ..... 184/6.18
5,785,151 A * 7/1998 Fry et al. ..... 184/6.16
5,887,678 A * 3/1999 Lavender ..... 184/11.2

FOREIGN PATENT DOCUMENTS

DE 1 150 175 12/1963
DE 2 232 430 1/1994 ..... F04B/39/00
DE 195 16 811 C2 4/1998 ..... H02K/3/38

* cited by examiner

*Primary Examiner*—David A. Bucci
*Assistant Examiner*—Timothy McAnulty
(74) *Attorney, Agent, or Firm*—McCormick, Paulding & Huber LLP

(57) ABSTRACT

The invention concerns a piston compressor, particularly a hermetically enclosed piston compressor, with a housing, in which a motor is arranged, the motor having a crankshaft with a vertically standing crank pin that has in its upper front side an opening, which is connected with an oil supply arrangement. It is endeavored to reduce an external oil circulation. For this purpose, the opening is provided with a limiting arrangement, which limits an axially directed movement of lubricating oil from the opening to a predetermined area.

10 Claims, 3 Drawing Sheets

PISTON COMPRESSOR

CROSS REFERENCE TO RELATED APPLICATIONS

This application is entitled to the benefit of, and incorporates by reference, essential subject matter disclosed in German Patent Application No. 101 06 234.6 filed on Feb. 10, 2001.

FIELD OF THE INVENTION

The invention concerns a piston compressor, particularly a hermetically enclosed piston compressor, with a housing, in which a motor is arranged, the motor having a crankshaft with a vertically standing crank pin that has in its upper front side an opening, which is connected with an oil supply arrangement.

BACKGROUND OF THE INVENTION

A compressor of this kind is known from DE-OS 22 32 430. Here, the crankshaft has an axial through-bore, whose lower end opens into a hollow cone, which is immersed in an oil sump. At the upper end, the through-bore is connected with an inclined bore, which ends at the front side of the crank pin. On a rotation of the crankshaft, lubricating oil is discharged from the oil sump by means of centrifugal force and supplied to the front side of the crank pin. The crank pin is surrounded by a bushing, in which an oil reservoir can build up. On rotation of the crankshaft, the oil available in the oil reservoir moves on the inside of the housing by means of centrifugal force, where it can release heat to the environment, when flowing back to the oil sump by way of gravity. In a predetermined circumferential section, the bushing has an axial extension, which is directed so that the oil cannot immediately be spun onto the cylinder block. Thus, this extension causes the centrifuged oil to be transported past the cylinder head before reaching the inner wall of the housing.

U.S. Pat. No. 4,569,639 A shows another refrigerant compressor with an oil pipe, fixed with one end in the front side opening of the crank pin. The other end of the oil pipe can now be directed so that the oil cannot be centrifuged onto the top wall of the housing, but only onto the circumferential wall. Further, the oil pipe has a radial bore, which permits oil to escape in the direction of the cylinder head, in which an oil distribution arrangement is arranged, which distributes the oil over the whole cylinder head.

In both of the above-described cases, it can be observed that an unacceptable amount of oil is sucked into the suction muffler and the cylinder together with the suction gas. After compression, this oil reaches the refrigeration system, which is supplied by the piston compressor. This phenomenon is known as "external oil circulation". However, external oil circulation has several disadvantages. First, under unfavourable circumstances, so much oil can be removed from the oil sump of the compressor that a sufficient lubrication of the moving parts in the compressor is no longer ensured. Second, the refrigeration performance of the complete refrigeration system is deteriorated, as the oil reduces the heat transfer coefficients in the heat exchangers. This applies for both the evaporator and the condenser. The free flow cross section for the refrigerant in the capillary tubes of the system can be reduced, which could, in the extreme case, cause a complete choking of the thin tubes.

Thus, the invention is based on the task of reducing the external oil circulation.

SUMMARY OF THE INVENTION

With a piston compressor as mentioned in the introduction, this task is solved in that the opening is provided with a limiting arrangement, which limits an axially directed movement of lubricating oil from the opening in a predetermined area.

Due to the limitation of the axial movement, it is now possible to exclude certain areas of the inner wall of the housing completely from an oil supply. This is independent of the speed of the crankshaft. Thus, an area of the inner wall of the housing can intentionally be kept free of oil.

For example, it can be avoided that oil reaches the part of the housing wall situated directly over the suction fitting and drops down on the mouth of the suction fitting. If this was the case, large amounts of oil particles would be carried along by the suction flow and get into the suction muffler. Such a case is particularly problematic with compressors with so-called direct suction, whose suction fitting is connected direct with the inlet of the suction muffler by means of a flexible connection. Often, the flexible connection is realised by means of mutually displaceable telescopic pipes, in order to avoid that vibrations, which particularly occur in connection with turning on and turning off, cause line ruptures. However, the telescopic connections cannot be made completely tight.

A further complication occurs in that the pressure inside the housing is slightly higher than the suction pressure in the suction line, meaning that oil is practically sucked into the suction gas flow from the housing interior, when the oil is permitted to come close to leaky connections. When, however, it is ensured that the oil flow is kept away from such critical spots, the risk of oil reaching the refrigerant circuit is greatly reduced. By means of the specific screening of the oil, it can also be prevented that the cylinder head is sprayed with the lubricating oil. Also this serves the purpose of preventing the penetration of oil through the connections between the suction muffler and the valve plate. For tolerance and assembly reasons, the connections cannot always be made completely tight. In this connection, the opening can be made direct in the front side of the crank pin. However, it is also possible, and in many cases also preferable, that the front side is surrounded by a bushing, whose upper edge forms the opening.

Preferably, the limiting arrangement is in connection with the edge of the opening. The limiting arrangement can, for example, have an axially extending wall, which extends the edge of the opening on part of its circumference. Thus, further to the axial limitation of the centrifuged oil, also a radial limitation of the oil flow can be realised. The areas, which can be kept free of oil, can thus be chosen even more specifically.

Preferably, the limiting arrangement has a deflector element, which faces the front side. This is a relatively simple design of a limiting arrangement. The deflector element partly covers the opening in the axial direction, if required, at a distance. When the oil reaches the deflector element, it is retarded and led back to the oil reservoir, which has built up at the opening in the front side of the crank pin. Additionally, this arrangement involves the advantage that the energy is not lost, which had to be procured to transport the oil to the opening. The oil retarded by the deflector element is then supplied to another place in the housing.

Preferably, the limiting arrangement is arranged to be unrotatable in relation to a connecting rod, which cooperates with the crank pin. On the one hand, the connecting rod produces a spatial allocation between the limiting arrangement and the crank pin, to ensure that also on a rotation of the crankshaft the limiting arrangement always remains in the correct position in relation to the crank pin and the opening. On the other hand, the placing of the limiting arrangement on the connecting rod ensures that during a rotation of the crankshaft a predetermined angle area is always prevented from delivering oil. In a manner of speaking, this angle area is the shadow area, which the limiting arrangement creates on one rotation. Adjacent areas will receive less oil during a rotation of the crank pin. However, they are still supplied with oil.

Preferably, the extension of the deflector element in parallel to the front side corresponds to a circle sector. The extension can also be denoted as a projection perpendicular to the front side or as a cross-section in parallel to the front side. The side of the extension, facing the front side, can be convex, one-side or multi-side inclined or plane. The sector ensures a complete covering of the predetermined area, also at relatively high speeds of the crankshaft. Of course, also other embodiments are possible, for example a circle section or an annulus. However, it must be ensured that also with maximum speed of the crankshaft no oil is transported past the deflector element and into the predetermined area, which are to be excluded from an oil supply.

Preferably, the limiting arrangement is made as a put-on part, which is fitted on the connecting rod. This embodiment involves advantages with regard to costs and assembly, as basically, the limiting arrangement does not have to be fitted until the crankshaft, the connecting rod, the piston and the cylinder block have been assembled.

Preferably, the put-on part is in the form of a cylindrical bushing, which is fitted on a connecting rod eye that surrounds the crank pin. Such a part is easily manufactured, for example from metal. Preferably, however, a temperature, oil and refrigerant resistant plastic is used, if required in a reinforced form. Then, the put-on part can be made by means of injection moulding.

Preferably, the put-on part forms a snap connection together with the connecting rod eye. This simplifies the mounting, and ensures a reliable retaining of the put-on part in the desired position.

It is also advantageous, when the limiting arrangement is oil permeable in an area, which is directed towards the connecting rod. In spite of the screening, it is desirable and advantageous to lubricate and cool the reverse of the piston, the bolt bearing between the connecting rod and the piston bolt as well as the rear end of the cylinder wall surface by means of an oil jet. This improves the lubricating and wear conditions and causes an improved sealing of the compression chamber. Accordingly, a smaller amount of refrigerant penetrates through the gap between the piston and the cylinder during the compression process, which means that the efficiency of the compressor is improved. In fact, it is sufficient that in this spot the limiting arrangement has a hole or another opening, through which the oil jet can pass. A side effect of this hole is that the limiting arrangement, particularly when being in the shape of a put-on part, is easier to widen in the radial direction by this hole, so that it can more easily be fitted on to the connecting rod eye.

Preferably, the crank pin is surrounded by a rotatable bushing, which projects axially over the crank pin and forms a vessel, the bushing being unrotatably connected with the connecting rod eye and having an auxiliary opening, which is directed towards the connecting rod. Now, the oil jet cannot only be realised in that the oil runs over the edge of the opening and then passes through the limiting arrangement, but also more specifically in that the bushing has the auxiliary opening, the limiting arrangement not being permitted to form any objection for the oil jet in the area of the auxiliary opening.

Preferably, the auxiliary opening is in the shape of a slot. Then, on the one hand, it can be made large enough to let sufficient oil pass. On the other hand, the spatial extension of the oil jet will be limited, so that it can be directed relatively accurately to the spots to be lubricated.

BRIEF DESCRIPTION OF THE DRAWINGS

In the following, the invention is described on the basis of a preferred embodiment in connection with the drawings, showing.

DETAILED DESCRIPTION OF THE PREFERRED EMBODIMENTS

Figure 1:
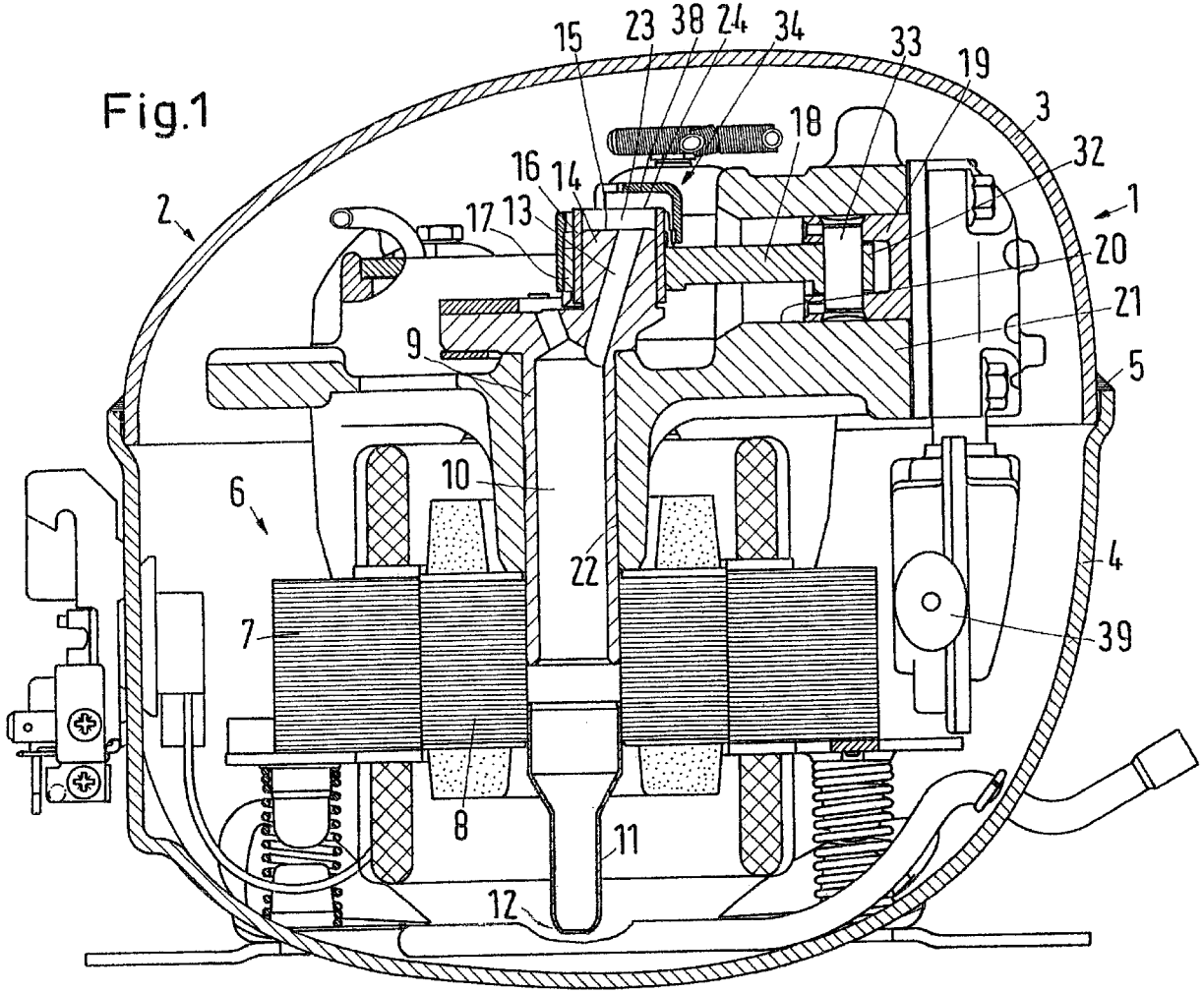
FIG. 1 is a cross-sectional view of a compressor

As shown in FIG. 1, a piston compressor 1 has a housing 2, which is made as a hermetically sealed enclosure. The housing 2 has an upper part 3 and a lower part 4, which are joined by means of a weld seam 5.

In the housing 2 is arranged an electric motor 6, having a stator 7, in which a rotor 8 is rotatably supported. A crankshaft 9 is unrotatably connected with the rotor. The crankshaft 9 has a through-bore 10. Under its lower end is arranged a hollow cone 11, whose top is immersed in an oil sump 12. At its upper end, the through-bore 10 continues in an inclined bore 13, which penetrates a crank pin 14 and ends at its upper front side 15. The crank pin 14 is arranged eccentrically to the crankshaft 9, in such a way that it orbits around the crankshaft axis on a rotation of the crankshaft.

A bushing 16 surrounds the crank pin 14 rotatably. The bushing 16 is unrotatably pressed into a connecting rod eye 17 of a connecting rod 18. The other end of the connecting rod 18 is connected with a piston 19, which is axially displaceable in a cylinder 20. The cylinder 20 is made in a cylinder block 21, which also comprises a bearing 22 for the crankshaft 9.

Upon rotary movement of the crankshaft 9, oil is sucked from the oil sump 12 and, via the through-bore 10 and the inclined bore 13, reaches a vessel 23 that is surrounded by the bushing 16 and the crank pin 14, the upper front side 24 of said vessel 23 forms an opening, through which the oil can be discharged, when, due to the centrifugal force, the oil flows over the edge of the bushing 16. Caused by the oil transport through the hollow cone 11 and the inclined bore 13, jointly forming a pump, the oil leaving the vessel 23 comprises a component in the axial direction, which can no longer be neglected, the direction statements here referring to the rotational axis of the crankshaft 9. At the same time, the oil in the vessel 23 forms a reservoir, by means of which the contact surface between the bushing 16 and the crank pin 14 can be lubricated.

Figure 2:
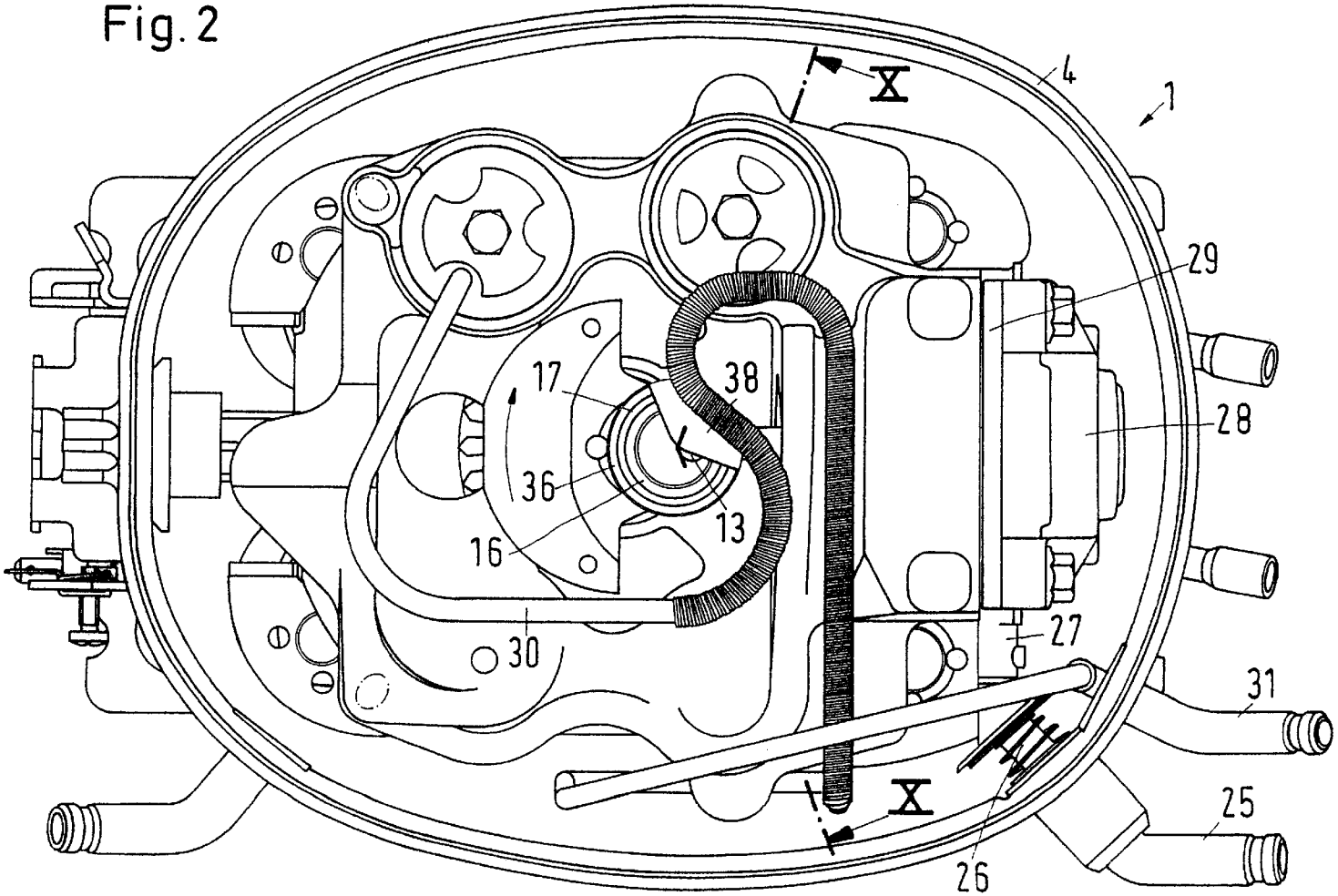
FIG. 2 is a top view of the compressor with dismounted housing cover

Referring to FIG. 2, when the piston 19 shown in FIG. 1 moves to the left, refrigerant gas is sucked into the cylinder 20 via a suction fitting 25, a telescopic pipe 26, a suction muffler 27, a cylinder head 28, and a valve arrangement made in a valve plate 29, but not shown in detail. On a movement to the right, the gas is compressed and expelled from the compressor through a pressure gas line 30 and a pressure fitting 31.

The connecting rod 18 is connected with a piston bolt 33 via a rod eye 32.

Thus, a movement of the piston 19 is conditioned by a rotation of the crankshaft 9. As stated above, this rotation of the crankshaft 9 causes oil from the vessel 23 to be centrifuged on to the inner wall of the housing 2. FIG. 2 schematically shows an area "X", which should be kept free of oil. In this area, the suction arrangement of the compressor 1 is arranged, particularly the telescopic pipe 26 and the suction muffler 27.

Figure 3:
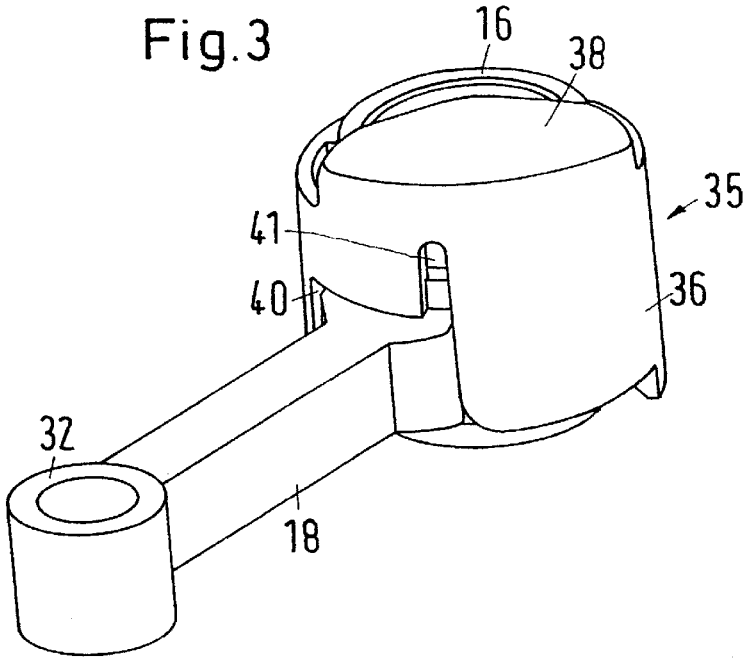
FIG. 3 is a perspective top view of a connecting rod with mounted limiting arrangement
Figure 4:
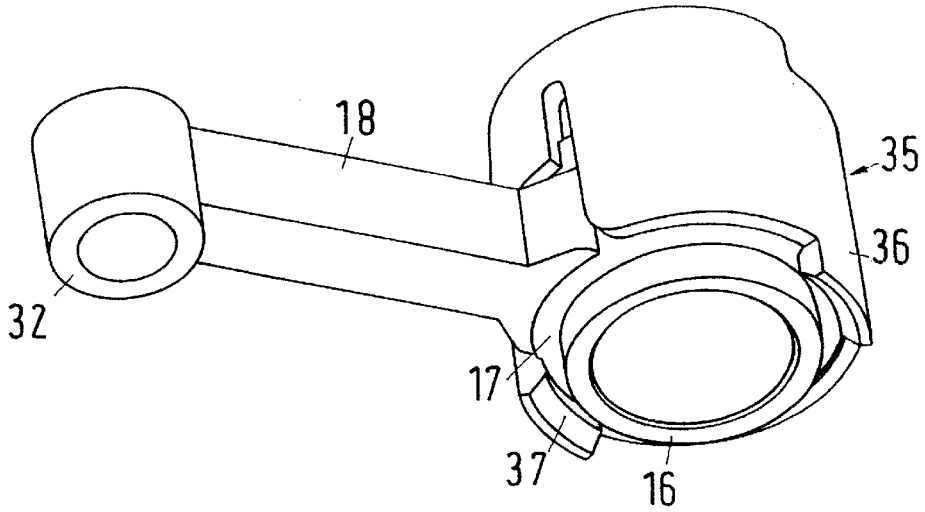
FIG. 4 is a perspective bottom view corresponding to FIG. 3

In order to prevent an oil supply to this area, a limiting arrangement 34 is provided. This limiting arrangement 34 is made as a put-on part 35, and appears more clearly from the FIGS. 3 and 4. The put-on part 35 has a cylindrical part 36, with which it is fitted onto the connecting rod eye 17. Snap elements 37 are provided, with which the put-on part grabs at the connecting rod eye 17 in such a way that the put-on part 35 forms a snap connection with the connecting rod 18. On the upper side, the cylindrical part 36 continues into an extension 38 extending radially inwards, said extension 38 forming a deflector element and having the shape of a circle section. The circle section extends approximately to the centre of the bushing 16.

In the area of the extension 38, the oil cannot escape from the vessel 23 axially, as the cylindrical part 36 prevents this. Therefore, the oil is retained in the vessel 23 in the area of the extension 38, and must escape elsewhere. In this way, the area "X" of the inner wall of the housing 2 and the cylinder block 21 are kept free, so that no oil or only small amounts of oil reach the area around the opening of the suction fitting 25 inside the housing 2. Also the connections to the telescopic pipe 26 and the inlet opening 39 of the suction muffler 27 are kept free. Thus, large amounts of oil are prevented from getting into the suction gas flow, which increases the efficiency of the compressor.

The put-on part 35 has a recess 40, which extends across the rod element of the connecting rod 18. Thus, it is ensured that the put-on part 35 is unrotatably retained on the connecting rod eye 17. A rotation of the crankshaft 9 results in an orbiting movement of the crank pin 14. The extension 38 however, is only swung to and from by a limited angle area in relation to the vessel 23. This angle area corresponds to the deflection of the connecting rod 18 in relation to the crank pin 14.

In order to ensure that the piston 19 can be supplied with lubricating oil, a slot-like auxiliary opening 41 is provided in the cylindrical part 36 of the put-on part 35, which opening projects somewhat over the bushing 16 in the axial direction. Thus, a path is available, through which oil from the vessel 23 can be directed to the reverse of the piston 19 in a limited jet. This improves the lubricating conditions at the piston bolt 33. At the same time, the contact face between the piston 19 and the cylinder 20 can be lubricated, so that an improved sealing in the cylinder 20 is obtained. With this embodiment only the oil flowing over the edge of the bushing gets through the auxiliary opening 41. However, an additional auxiliary opening can be provided in the bushing, also having a slot-like shape, and having the same direction as the auxiliary opening 41. In this case, the oil volume can be even better controlled.

What is claimed is:

1. A piston compressor comprising:

a housing;

a motor positioned in the housing, the motor having a crankshaft coupled thereto;

an eccentric crankpin extending from an end of the crank-shaft generally opposite the motor, the crankpin being adapted to engage a connecting rod;

the crankshaft defining a first bore extending therethrough and in fluid communication with a second bore extending through the crankpin, the first and second bores being in fluid communication with one another and with an oil sump so that during operation of the compressor, oil is drawn from the sump through the first and second bores and out of an opening in the crankpin;

a limiting arrangement in the form of a deflector plate coupled to the connecting rod adjacent the crankpin and opening, the deflector plate defining a top surface that only partially covers an end of the crankpin; and wherein said top surface of said deflector plate, said crank pin and said opening cooperate to allow oil to flow from said opening, past said top surface while selectively preventing the flow of oil from contacting a predetermined area of the piston compressor.

2. A piston compressor according to claim 1, wherein the limiting arrangement engages an edge defining the opening.

3. A piston compressor according to claim 1, wherein the limiting arrangement is arranged to be unrotatable in relation to the connecting rod, which cooperates with the crank pin.

4. A piston compressor according to claim 1, wherein the limiting arrangement is made as a put-on part, which is fitted on the connecting rod.

5. A piston compressor according to claim 4, wherein the put-on part is in the form of a cylindrical bushing, which is fitted on a connecting rod eye that surrounds the crank pin.

6. A piston compressor according to claim 5, wherein the put-on part forms a latch connection together with the connecting rod eye.

7. A piston compressor according to claim 1, wherein at least a portion of the limiting arrangement is oil permeable, the portion being directed toward the connecting rod.

8. A piston compressor according to claim 7, wherein the crank pin is surrounded by a rotatable bushing, which projects over the crank pin and forms a vessel, the bushing being unrotatably connected with the connecting rod eye and having an auxiliary opening, which is directed towards the connecting rod.

9. A piston compressor according to claim 8, wherein the auxiliary opening is in the shape of a slot.

10. A piston compressor comprising:

a housing;

a motor positioned in the housing, the motor having a crankshaft coupled thereto;

an eccentric crankpin extending from an end of the crankshaft generally opposite the motor, the crankpin being adapted to engage a connecting rod;

the crankshaft defining a first bore extending therethrough and in fluid communication with a second bore extending through the crankpin, the first and second bores being in fluid communication with one another and with an oil sump so that during operation of the compressor, oil is drawn from the sump through the first and second bores and out of an opening in the crankpin; and a cylindrical bushing fitted on a connecting rod eye surrounding the crank pin, the cylindrical bushing and the connecting rod eye cooperating to form a latch connection.

* * * * *